US006783373B2

(12) United States Patent
Hsu et al.

(10) Patent No.: US 6,783,373 B2
(45) Date of Patent: Aug. 31, 2004

(54) WIRELESS NETWORK ACCESS APPARATUS HAVING CURVED ANTENNA

(75) Inventors: Chih-Min Hsu, Taipei (TW); Ten-Long Dang, Hsinchu Cou (TW)

(73) Assignee: Asustek Computer Inc., Taipei (TW)

( * ) Notice: Subject to any disclaimer, the term of this patent is extended or adjusted under 35 U.S.C. 154(b) by 0 days.

(21) Appl. No.: 10/329,918

(22) Filed: Dec. 30, 2002

(65) Prior Publication Data

US 2003/0124883 A1 Jul. 3, 2003

(30) Foreign Application Priority Data

Dec. 31, 2001 (TW) ..... 90224700 U

(51) Int. Cl.[7] ..... H01R 12/00

(52) U.S. Cl. ..... 439/76.1; 439/8; 361/752; 343/702; 343/904; 379/433; 455/89; 381/154

(58) Field of Search ..... 439/76.1, 8; 361/752; 343/702, 904; 379/433; 455/89; 381/154

(56) References Cited

U.S. PATENT DOCUMENTS 3,851,119 A * 11/1974 Tucker ..... 379/454
5,428,444 A * 6/1995 Haddock et al. ..... 356/458
5,555,449 A * 9/1996 Kim ..... 455/575
5,731,964 A * 3/1998 Kitakubo et al. ..... 361/816
5,734,716 A * 3/1998 Kulberg ..... 379/433.13
5,744,934 A * 4/1998 Wu ..... 320/111
5,798,734 A * 8/1998 Ohtsuka et al. ..... 343/700 MS

* cited by examiner

*Primary Examiner*—Anthony Dinkins
*Assistant Examiner*—Anton Harris
(74) *Attorney, Agent, or Firm*—Rabin & Berdo, PC

(57) ABSTRACT

A wireless network access apparatus includes a circuit board received in a housing and having one or more devices for communicating with various wireless network systems. An antenna is attached to the housing and coupled to the circuit board, and includes a curved surface for effectively receiving microwave signals. The housing includes a seat for selectively supporting the antenna. A cover is slidably secured to the housing for exposing the seat when the seat is secured to the housing, and for shielding the housing when the seat is removed from the housing.

17 Claims, 9 Drawing Sheets

WIRELESS NETWORK ACCESS APPARATUS HAVING CURVED ANTENNA

BACKGROUND OF THE INVENTION

1. Field of the Invention

The present invention relates to a wireless network access apparatus, and more particularly to a wireless network access apparatus having a curved antenna for facilitating signal receiving effect.

2. Description of the Prior Art

Typical wireless network access facilities, such as local area wireless network (LAN) cards or devices, and wireless local area wireless network (WLAN) cards or devices, etc., have been developed for allowing users to communicate with various wireless network systems, such as ethernet, and the like.

The typical wireless network access facilities communicate with each other with microwave signals which may be transmitted in straight lines, and may not be transmitted with a diffraction effect. The microwave signals may be transmitted by the wireless network access facilities for about 100 m in buildings, and for about 300 m outdoors. Accordingly, a number of wireless network access facilities need to be widely built or installed everywhere, for allowing the users to communicate with the wireless network systems.

The typical wireless network access facilities comprise the typical telescopic antenna for communication purposes. However, the typical telescopic antenna may not be used to effectively receive the microwave signals, such that the users may not easily communicate with the wireless network systems with the typical wireless network access facilities.

The present invention has arisen to mitigate and/or obviate the afore-described disadvantages of the conventional wireless network access facilities.

SUMMARY OF THE INVENTION

The primary objective of the present invention is to provide a wireless network access apparatus including a curved antenna for facilitating a signal receiving effect.

The other objective of the present invention is to provide a wireless network access apparatus including a slidable cover selectively or optionally provided and slidably attached to a housing for selectively shielding the housing.

In accordance with one aspect of the invention, there is provided a wireless network access apparatus comprising a housing, a circuit board received in the housing, and including means for communicating with wireless network systems, and an antenna attached to the housing and coupled to the circuit board, and including a curved surface provided thereon for effectively receiving microwave signals.

The housing includes a seat attached thereto for supporting the antenna. The seat includes a socket provided thereon, the antenna includes a rotatable member provided thereon and rotatably secured in the socket of the seat, for allowing the antenna to be rotated relative to the seat.

The socket includes a wall member having a slot formed therein for increasing a resilience of the socket, and for facilitating an engagement of the rotatable member into the socket. The seat includes a cap attached thereto for defining the socket thereof. The antenna includes a shank extended therefrom, and the rotatable member is provided on the shank of the antenna.

The housing includes a portion having the seat attached thereto, and a cover, such as a front cover slidably attached to the housing and movable away from the portion of the housing for exposing the seat.

The housing includes at least one oblong hole formed therein, and the front cover has at least one stud extended therefrom and slidably engaged in the oblong hole of the housing. The oblong hole of the housing includes two ends, and the housing includes a retaining device for retaining th6 stud of the cover in either of the ends of the oblong hole of the housing.

The housing includes at least one latch extended therefrom, and the front cover has at least one channel formed therein for slidably receiving the latch of the housing. The cover includes a notch formed therein and having a length smaller than that of the channel of the cover, for receiving the latch of the housing before the latch of the housing is engaged into the channel of the cover. The cover includes a flange extended therefrom and having the notch and the channel formed in the flange of the cover.

The housing includes a rear portion having a rear cover detachably secured thereto, and a bracket selectively attached to the rear portion of the housing when the rear cover is disengaged from the housing. The rear portion of the housing includes at least one key hole formed therein, the bracket includes at least one hook engageable into the key hole of the housing for attaching the housing to various objects.

Further objectives and advantages of the present invention will become apparent from a careful reading of a detailed description provided hereinbelow, with appropriate reference to accompanying drawings.

DETAILED DESCRIPTXOM OF THE PREFERRED EMBODIMEMT

Figure 1:
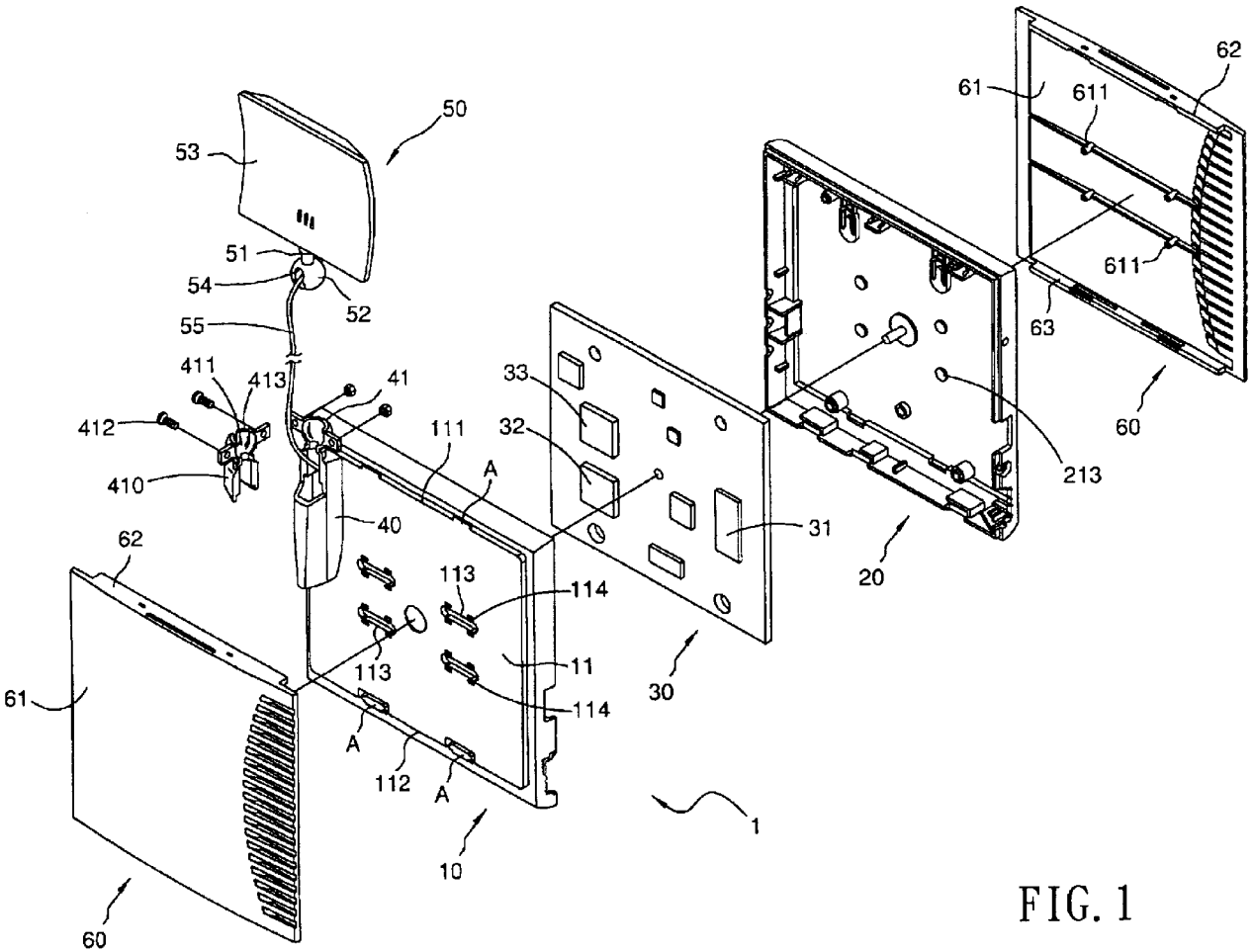
FIG. 1 is an exploded view of a wireless network access apparatus in accordance with the present invention.

Referring to the drawings, and initially to FIGS. 1–5, a wireless network access apparatus in accordance with the present invention comprises a housing 1 including two casings 10, 20 secured together with fasteners, latches, adhesive materials, or by welding processes, etc., a circuit board 30 received or secured within the housing 1, and two covers 60 to be attached to the front and the rear portions of the housing 1.

The circuit board 30 includes one or more processor devices 31 (FIG. 1) and one or more local area wireless network (LAN) cards or devices 32 and/or one or more wireless local area wireless network (WLAN) cards or devices 33, etc., attached thereto, and coupled together for communicating with various wireless network systems.

Figure 3:
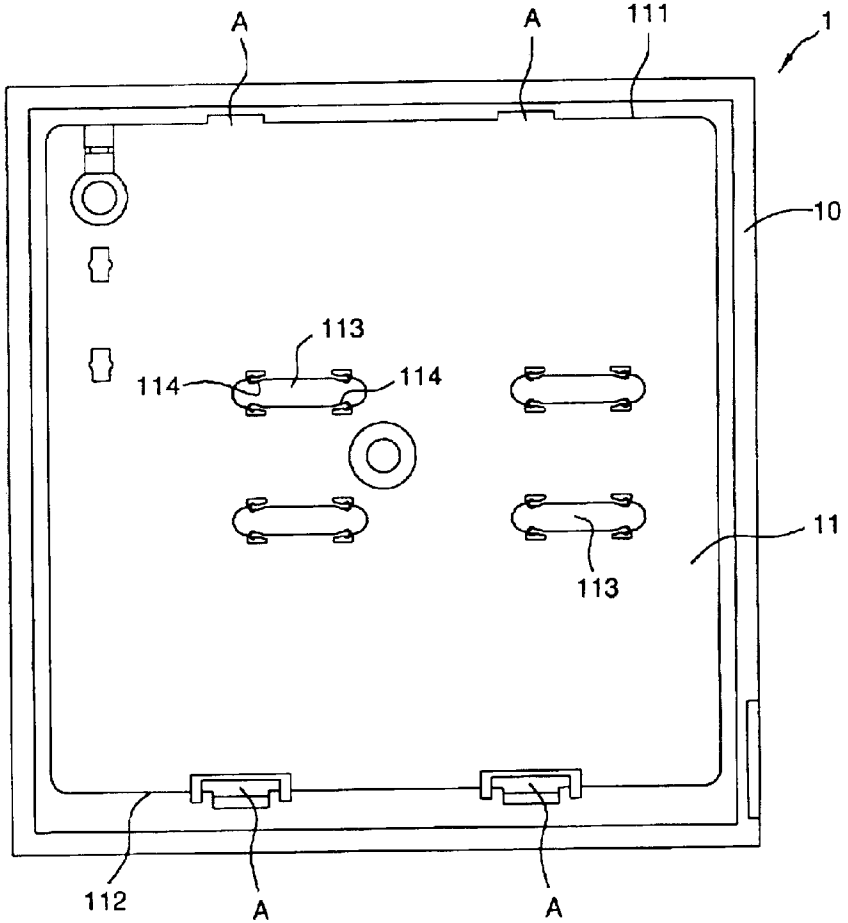
FIG. 3 is a front view of a housing of the wireless network access apparatus.

The first or the front casing 10 includes a front or an outer portion 11 having two opposite sides, such as upper and lower side 111, 112 each having one or more fasteners or latches A extended therefrom. The casing 10 includes one or more oblong holes 113 laterally formed therein, and each having two ends, and includes one or more spring-biased catches 114 extended into each of the ends of each of the oblong holes 113 of the casing 10 (FIGS. 1, 3).

Figure 5:
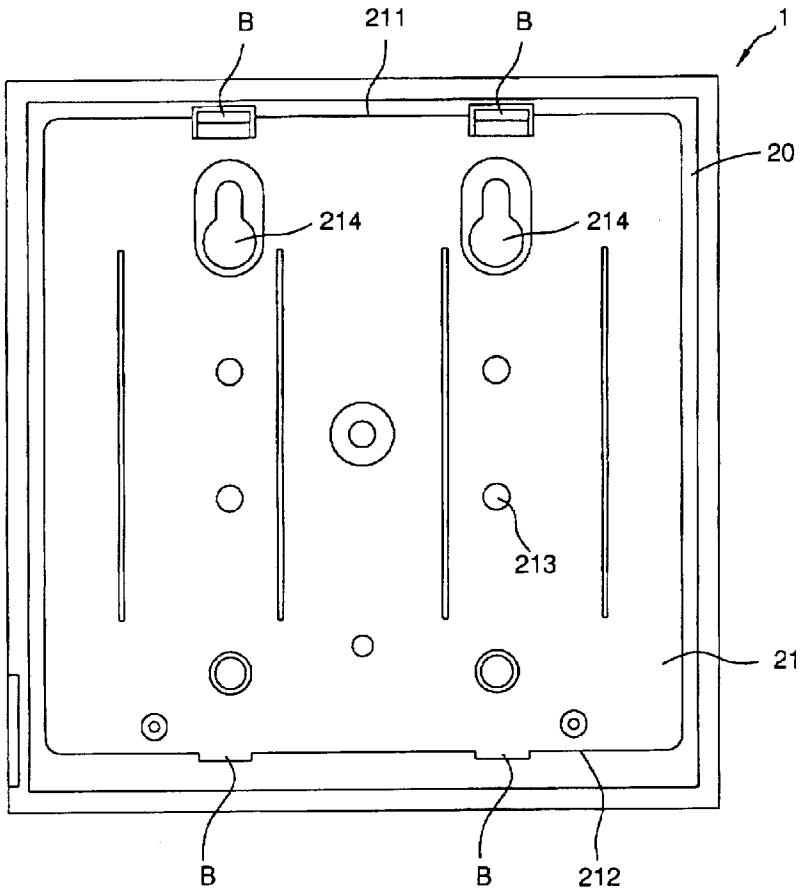
FIG. 5 is a rear view of the housing of the wireless network access apparatus.

As shown in FIG. 5, the second or the rear casing 20 includes an outer portion 21 having two opposite sides, such as upper and lower sides 211, 212 each having one or more fasteners or latches B extended therefrom. The casing 20-includes one or more apertures 213 formed therein, and one or more key holes 214 formed therein for hanging or attaching purposes.

The front casing 10 includes a seat 40 detachably secured thereto with latches I or fasteners (not shown), and disposed on one side thereof, and having a ball socket 41 formed or provided therein. For example, a cap 410 is secured to the outer portion of the seat 40 with such as fasteners 412, and has a wall member 413 formed or provided thereon for forming the front or outer portion of the ball socket 41. The ball socket 41 includes a slot 411 formed in the wall member 413 or formed in the front portion thereof.

Figure 7:
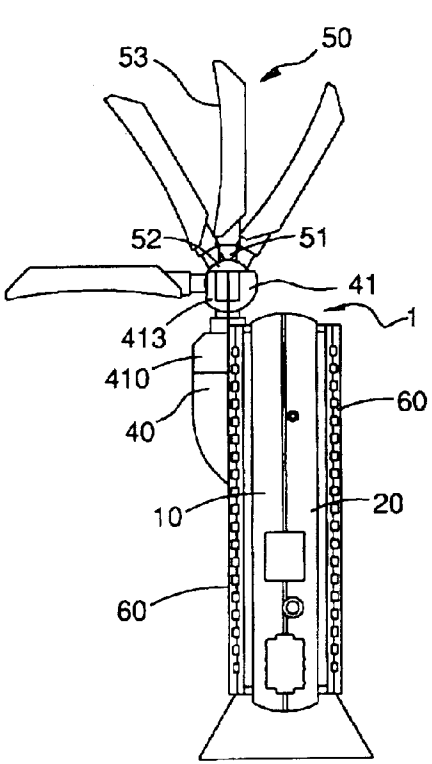
FIG. 7 is a side view illustrating the operation of the wireless network access apparatus.
Figure 6:
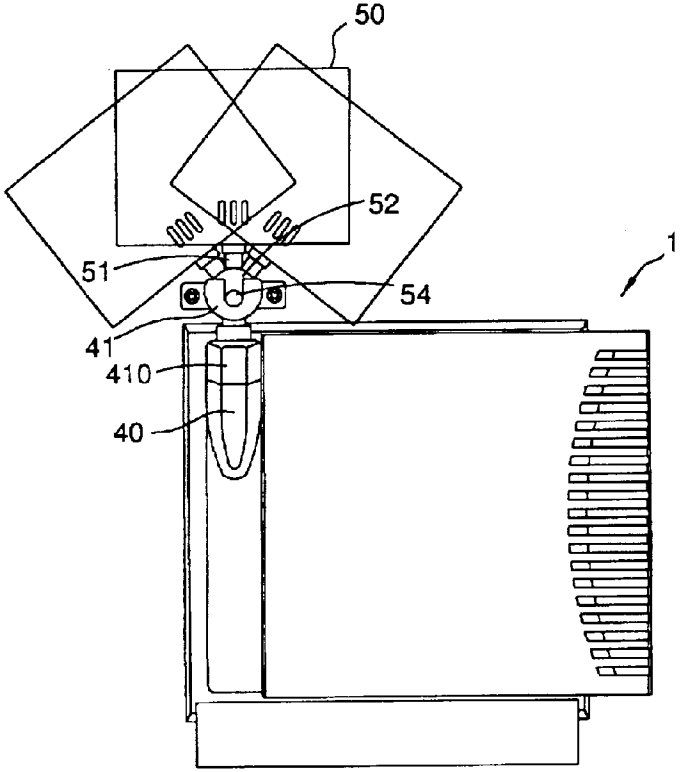
FIG. 6 is a front view illustrating the operation of the wireless network access apparatus.

An antenna 50 includes a shank 51 extended therefrom, such as extended downwardly therefrom, and a pivotal or rotatable member 52, such as a ball 52 attached or secured to the shank 51 and rotatably received in the ball socket 41 of the casing 10, for allowing the antenna 50 to be rotated relative to the housing 1 in various angular directions (FIGS. 6, 7). The provision or the formation of the slot 411 in the ball socket 41 is provided for increasing the resilience of the ball socket 41 and for allowing the rotatable member 52 to be easily engaged into and retained in the ball socket 41.

As shown in FIGS. 1 and 6, the rotatable member 52 includes a cavity 54 formed therein for receiving one or more wires 55 which may be used for coupling the antenna 50 to such as the circuit board 30, particularly to the processor devices 31 of the circuit board 30, and for receiving and sending the microwave signals to the processor devices 31 of the circuit board 30. The antenna 50 includes a curved surface 53 formed or provided thereon for effectively receiving microwave signals.

Figure 4:
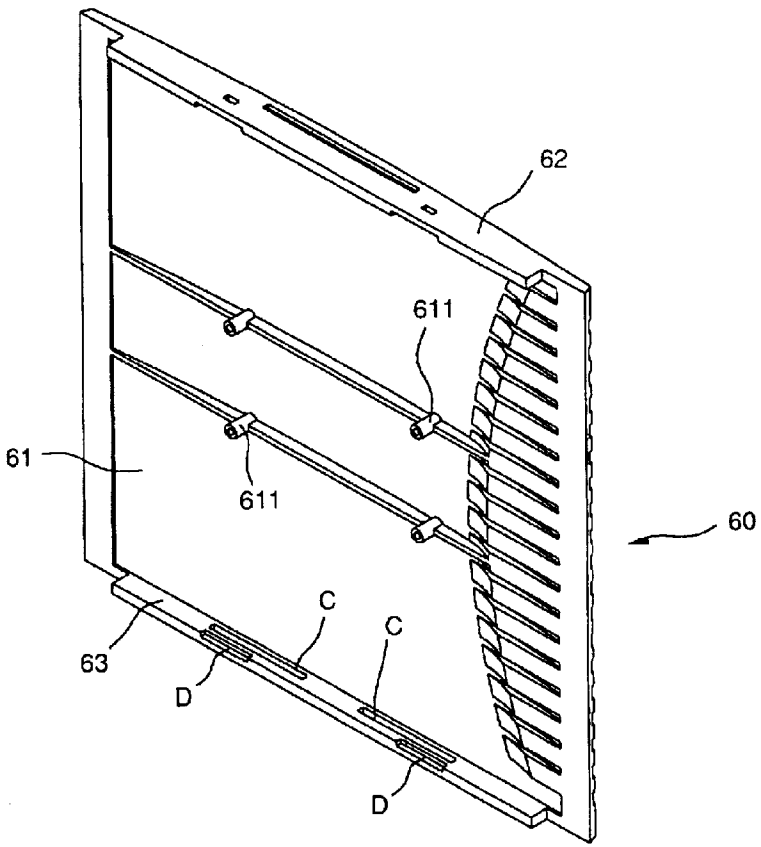
FIG. 4 is a rear perspective view of a cover of the wireless network access apparatus.

As show in FIGS. 1 and 4, the covers 60 each includes an inner portion 61 having one or more studs 611 extended therefrom, and each includes two opposite sides, such as upper and lower sides each having a flange 62, 63 extended therefrom. The flanges 62, 63 of the covers 60 each includes one or more pairs of channels C and notches D formed therein. The channel C of each cover 60 includes a length greater than that of the notch D of the cover 60.

When assembling or attaching the covers 60 onto the casings 10, 20 of the housing 1, the latches A, B of the casings 10, 20 may first be engaged into the corresponding notches D of the covers 60, and may then be forced to be engaged into the corresponding channels C of the covers 60 when the covers 60 are further forced against the casings 10, 20 of the housing 1. The covers 60 thus include an identical structure and may thus be easily manufactured in mass production.

It is preferable that the notches D of the covers 60 include a width or length about equal to that of the latches A, B of the casings 10, 20, for suitably receiving the corresponding latches A, B of the casings 10, 20, and the channels C of the covers 60 include a width or length longer than that of the latches A, B of the casings 10, 20 and that of the notches D of the covers 60, for allowing the covers 60 to be slid relative to the casings 10, 20 of the housing 1 when the latches A, B of the casings 10, 20 are slidably engaged in the corresponding channels C of the covers 60.

Figure 2:
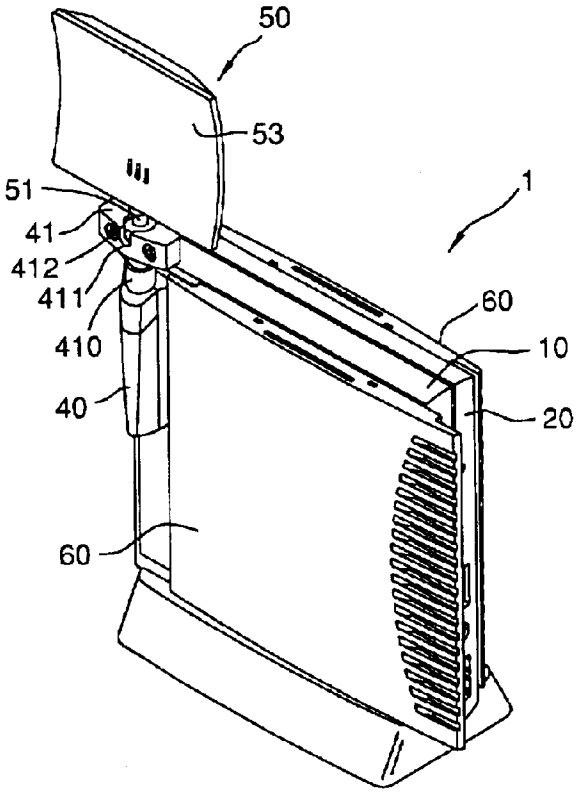
FIG. 2 is a perspective view of the wireless network access apparatus.
Figure 8:
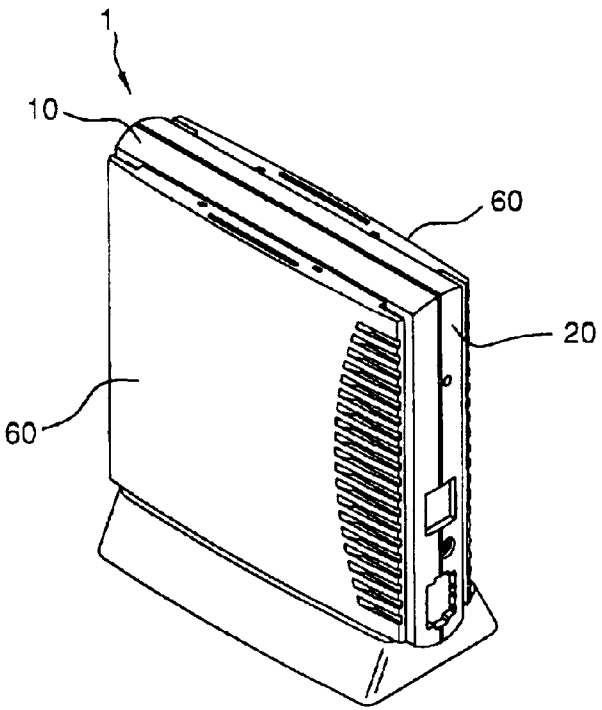
FIG. 8 is a perspective view of the wireless network access apparatus, in which the front cover is located in a close position.

The studs 611 of one of the covers 60, such as of the front cover 60 are slidably engaged in the oblong holes 113 of the front casing 10, such that the front cover 60 may be moved or slid laterally relative to the front casing 10, as shown in FIGS. 2 and 8. The catches 114 of the front casing 10 may engage with the studs 611 of the front cover 60 for retaining the studs 611 of the front cover 60 in either of the ends of the oblong holes 113 of the front casing 10.

For example, as shown in FIG. 2, when the seat 40 is secured to the housing 1, such as secured to one side portion of the housing 1, for supporting the antenna 50, the front cover 60 may be slid laterally relative to the housing 1, and may have one side portion laterally extended out of the housing 1, for exposing the seat 40.

As shown in FIG. 8, when the antenna 50 is not required and when the seat 40 is removed from the housing 1, the front cover 60 may also be slid laterally relative to the housing 1 back: to the original position that covers or shields the area or the side portion of the housing 1 where the seat 40 is previously attached to the housing 1.

The studs 611 of the rear cover 60 are provided for engaging into the apertures 213 of the rear casing 20, such that the rear cover 60 may not be moved or slid relative to the rear casing 20.

Figure 9:
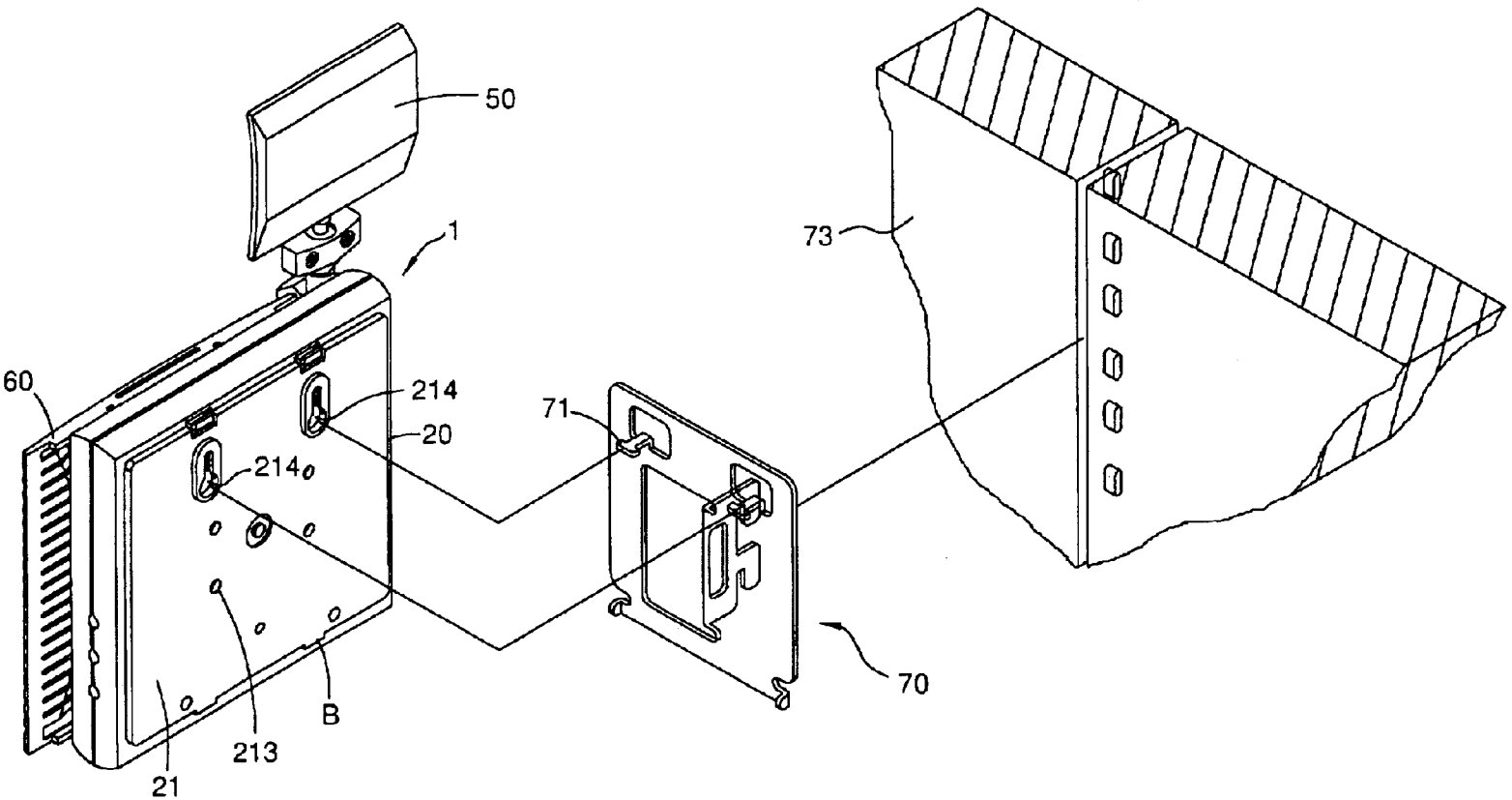
FIGS. 9, 10 are exploded views illustrating the operation or the attachment of the wireless network access apparatus to various objects.

Referring next to FIG. 9, when the rear cover 60 is removed or disengaged from the rear casing 20, a bracket 70 may optionally or selectively provided and nay include one or more hooks 71 engaged into the key holes 214 of the rear casing 20, for detachably attaching the housing 1 and/or the antenna 50 onto such as wall members 73.

Figure 10:
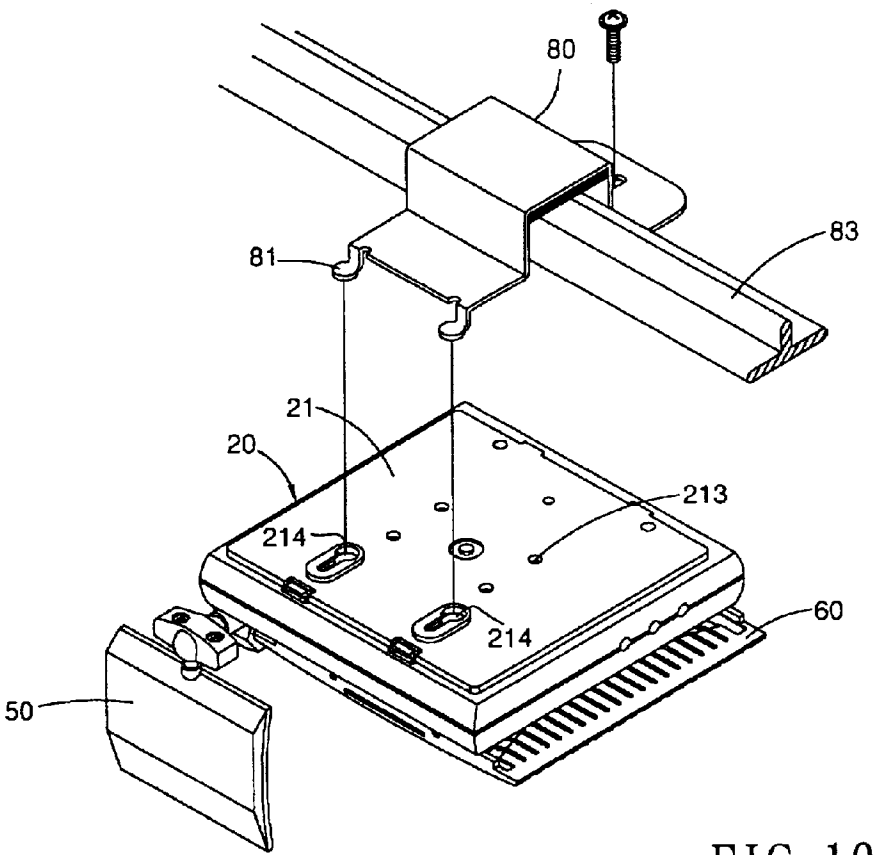

Referring next to FIG. 10, another bracket 80 may optionally or selectively provided and may include one or more hooks 81 engaged into the key holes 214 of the rear casing 20, for detachably attaching the housing 1 and/or the antenna 50 onto such as rail or rack or track members 83, or the like.

Accordingly, the wireless network access apparatus in accordance with the present invention includes a curved antenna for facilitating signal receiving effect, and includes a slidable cover selectively or optionally provided and slidably attached to the housing for selectively shielding the housing.

Although this invention has been described with a certain degree of particularity, it is to be understood that the present disclosure has been made by way of example only and that numerous changes in the detailed construction and the combination and arrangement of parts nay be resorted to without departing from the spirit and scope of the invention as hereinafter claimed.

What is claimed is:

1. A wireless network access apparatus comprising:

a housing that is provided with a ball socket, a circuit board received in said housing, and including means for communicating with wireless network systems, and a ball pivot member rotatably received in said ball socket; and an antenna attached to said ball pivot member and coupled to said circuit board, and including a curved surface provided thereon for receiving signals, wherein said ball pivot member and said ball socket permit said antenna to be rotated relative to said housing in various angular directions.

2. The wireless network access apparatus according to claim 1, wherein said ball socket includes a wall member having a slot formed therein for increasing a resilience of said ball socket, and for facilitating an engagement of said ball pivot member into said socket.

3. The wireless network access apparatus according to claim 1, wherein said antenna includes a shank extended therefrom, and said ball pivot member is provided on said shank of said antenna.

4. The wireless network access apparatus according to claim 1, wherein said housing includes a portion having said ball socket member attached thereto, and a cover slidably attached to said housing and movable away from said portion of said housing for exposing said ball socket member.

5. The wireless network access apparatus according to claim 1, wherein said housing includes at least one oblong hole formed therein, and a cover having at least one stud extended therefrom and slidably engaged in said at least one oblong hole of said housing.

6. The wireless network access apparatus according to claim 5, wherein said at least one oblong hole of said housing includes two ends, and said housing includes means for retaining said at least one stud of said cover in either of said ends of said at least one oblong hole of said housing.

7. The wireless network access apparatus according to claim 1, wherein said housing includes at least one latch extended therefrom, and a cover having at least one channel formed therein for slidably receiving said at least one latch of said housing.

8. The wireless network access apparatus according to claim 7, wherein said cover includes a notch formed therein and having a length smaller than that of said at least one channel of said cover, for receiving said at least one latch of said housing before said at least one latch of said housing is engaged into said at least one channel of said cover.

9. The wireless network access apparatus according to claim 8, wherein said cover includes a flange extended therefrom and having said notch and said at least one channel formed in said flange of said cover.

10. The wireless network access apparatus according to claim 1, wherein said housing includes a rear portion having a cover detachably secured thereto, and a bracket selectively attached to said rear portion of said housing when said cover is disengaged from said housing.

11. The wireless network access apparatus according to claim 10, wherein said rear portion of said housing includes at least one key hole formed therein, said bracket includes at least one hook engageable into said at least one key hole of said housing.

12. A wireless network access apparatus comprising:

a housing, including at least one latch extended therefrom, and a cover including at least one channel formed therein for slidably receiving said at least one latch of said housing, a notch formed therein and having a length smaller than that of said at least one channel of said cover, for receiving said at least one latch of said housing before said at least one latch of said housing is engaged into said at least one channel of said cover, and a flange extended therefrom and having said notch and said at least one channel formed in said flange of said cover;

a circuit board received in said housing, and including means for communicating with wireless network systems; and an antenna attached to said housing and coupled to said circuit board, and including a curved surface provided thereon for receiving signals.

13. The wireless network access apparatus according to claim 12, wherein said housing includes a seat attached thereto for supporting said antenna.

14. The wireless network access apparatus according to claim 13, wherein said seat includes a socket provided thereon, said antenna includes a rotatable member provided thereon and rotatably secured in said socket of said seat, for allowing said antenna to be rotated relative to said seat.

15. The wireless network access apparatus according to claim 14, wherein said socket includes a wall member having a slot formed therein for increasing a resilience of said socket, and for facilitating an engagement of said rotatable member into said socket.

16. The wireless network access apparatus according to claim 14, wherein said seat includes a cap attached thereto for defining said socket thereof.

17. The wireless network access apparatus according to claim 14, wherein said antenna includes a shank extended therefrom, and said rotatable member is provided on said shank of said antenna.

* * * * *